US008867754B2

(12) United States Patent
Nakajima et al.

(10) Patent No.: US 8,867,754 B2
(45) Date of Patent: Oct. 21, 2014

(54) DEREVERBERATION APPARATUS AND DEREVERBERATION METHOD

(75) Inventors: Hirofumi Nakajima, Wako (JP); Kazuhiro Nakadai, Wako (JP); Yuji Hasegawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 250 days.

(21) Appl. No.: 12/704,582

(22) Filed: Feb. 12, 2010

(65) Prior Publication Data

US 2010/0208904 A1 Aug. 19, 2010

Related U.S. Application Data

(60) Provisional application No. 61/152,355, filed on Feb. 13, 2009.

(51) Int. Cl.
*H04R 29/00* (2006.01)
*H04R 27/00* (2006.01)
*H04R 1/40* (2006.01)

(52) U.S. Cl.
CPC ..... *H04R 27/00* (2013.01); *H04R 1/406* (2013.01); *H04R 2227/009* (2013.01)
USPC ..... 381/58; 381/66

(58) Field of Classification Search
CPC ..... H04R 3/005; H04R 1/1083; H04R 1/406; H04R 3/04; H04R 1/403; H04R 2201/403; H04R 2430/24; H04R 2430/25; H04R 2499/11; H04R 3/12; H04R 5/033; H04R 2201/401; H04R 2201/405; H04R 2225/43; H04R 2410/05
USPC ..... 381/66, 92, 98, 56–58, 61, 63, 312, 381/321, 1, 17–23; 704/205, 200, 219; 379/406.08; 370/286, 289
See application file for complete search history.

(56) References Cited

U.S. PATENT DOCUMENTS 4,087,633 A * 5/1978 Fitzwilliam ..... 381/66
4,131,760 A * 12/1978 Christensen et al. ..... 381/66
5,774,562 A * 6/1998 Furuya et al. ..... 381/66
2009/0248403 A1* 10/2009 Kinoshita et al. ..... 704/219

FOREIGN PATENT DOCUMENTS

| | | |
|---|---|---|
| JP | 9-140000 | 5/1997 |
| JP | 9-261133 | 10/1997 |
| JP | 2000-305594 | 11/2000 |
| JP | 2003-99100 | 4/2003 |
| JP | 2004-133403 | 4/2004 |
| JP | 2008-292845 | 12/2008 |

OTHER PUBLICATIONS

Furuya, Kenichi et al., "Semi-blind dereverberation using an interchannel correlation matrix and a whitening filter," Technology Research Report of the Institute of Electronics, Information and Communication Engineers (IEICE), vol. J88-A(10):1089-1099 (2005).
Miyoshi, Masato et al., "Inverse Filtering of Room Acoustics," IEEE Transactions on Acoustics, Speech, and Signal Processing, vol. 36(2):145-152 (1988).
Nakajima, Hirofumi et al., "Blind dereverberation using decorrelation-based adaptive inverse filtering," Journal (Autumn) of Acoustical Society of Japan (ASJ), pp. 711-714 (2008).
Japanese Office Action for Application No. 2010-029500, 4 pages, dated Aug. 20, 2013.
Japanese Office Action for Application No. 2010-029501, 4 pages, dated Sep. 10, 2013.

* cited by examiner

*Primary Examiner* — Lun-See Lao
(74) *Attorney, Agent, or Firm* — Nelson Mullins Riley & Scarborough LLP; Anthony A. Laurentano

(57) ABSTRACT

A dereverberation apparatus includes a signal selecting unit which selects a sound signal to be used for dereverberation process from a plurality of sound signals, and a dereverberation processing unit which performs the dereverberation process for the selected sound signal.

13 Claims, 11 Drawing Sheets

*FIG. 5*
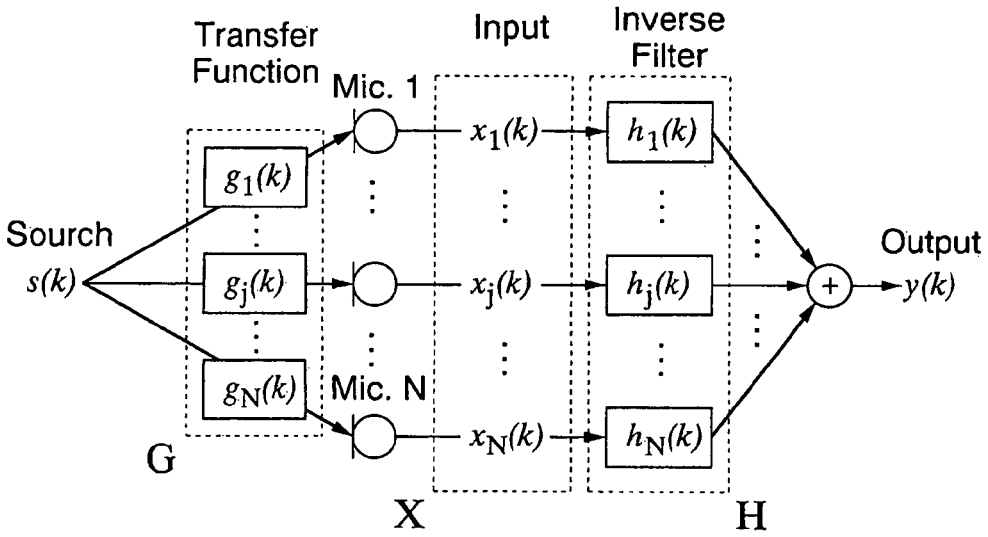
*FIG. 6*
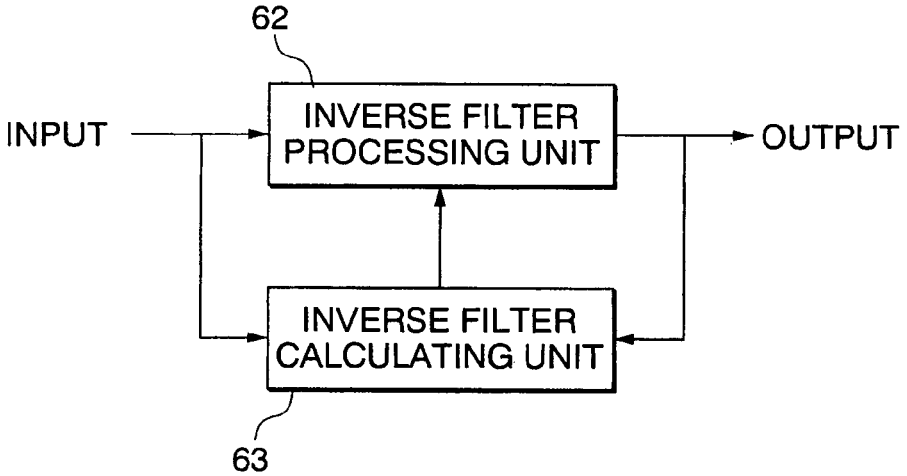
*FIG. 7*
MEASUREMENT CONDITIONS OF IMPULSE RESPONSE
| | |
|---|---|
| MEASUREMENT SITE | MULTIMEDIA ROOM<br>SIZE 5m x 6m x 2.5m, REVERBERATION TIME 380ms |
| MICROPHONE ARRAY | CIRCLE 8ch, DIAMETER 0.3m |
| ARRAY POSITION | ROOM CENTER, HEIGHT 1.2m |
| SPEAKER POSITION | MICROPHONE ARRAY FRONT 3m |
| SOUND SOURCE SIGNAL | TIME-STRETCHED PULSE (SIGNAL LENGTH 217) |

8ch: CIRCULAR MICROPHONE ARRAY

IMPULSE RESPONSE WAVEFORM

| NUMBER OF CHANNELS | USE CHANNEL | | | | | | |
|---|---|---|---|---|---|---|---|
| 2 | 1 | 4 | | | | | |
| 3 | 1 | 4 | 7 | | | | |
| 4 | 1 | 4 | 7 | 8 | | | |
| 5 | 1 | 4 | 5 | 7 | 8 | | |
| 6 | 1 | 2 | 4 | 5 | 7 | 8 | |
| 7 | 1 | 2 | 3 | 4 | 5 | 7 | 8 |
| 8 | 1 | ~ | 8 | | | | |

DEREVERBERATION APPARATUS AND DEREVERBERATION METHOD

CROSS REFERENCE TO RELATED APPLICATIONS

This application claims benefit from U.S. Provisional application Ser. No. 61/152,355, filed Feb. 13, 2009, the contents of which are incorporated herein by reference.

BACKGROUND OF THE INVENTION

1. Field of the Invention

The present invention relates to a dereverberation apparatus and a dereverberation method.

2. Description of the Related Art

A reverberation reducing process is an important technique used to pre-process auto-speech recognition, aiming at improvement of articulation in a teleconference call or a hearing aid and improvement of a recognition rate of auto-speech recognition used for speech recognition of a robot (robot hearing sense) (see, for example, Japanese Unexamined Patent Application, First Publication No. H09-261133). In the related art, there has been proposed a reverberation reducing process based on a Multiple-input/output INverse-filtering Theorem (MINT) which is theoretically capable of dereverberation with high precision without nonlinear distortion (see, for example, M. MIYOSHI and Y. KANEDA, "Inverse filtering of room acoustics," IEEE Transactions on Speech and Audio Processing, Vol. 36, No. 2, pp. 145-152, 1988). The reverberation reducing process for the auto-speech recognition of the robot hearing sense needs to satisfy three conditions, i.e., no pre-measurement of acoustic transfer characteristics (blind), real-time processability and no nonlinear distortion by the process.

Examples of methods to satisfy these three conditions may include a Semi-Blind-MINT (SBM) (see, for example, FURUYA Kenichi and KATAOKA Akitoshi, "Semi-blind dereverberation using an interchannel correlation matrix and a whitening filter," Technology Research Report of The Institute of Electronics, Information and Communication Engineers (IEICE), Vol. J88-A, No. 10, pp. 1089-1099, 2005), which is a dereverberation method based on MINT, and a Decorrelation-based Adaptive Inverse Filtering (DAIF) (see, for example, NAKAJIMA Hirofumi, NAKADAI Kazuhiro, HASEGAWA Yuuji and TSUJINO Hiroshi, "Blind dereverberation using decorrelation-based adaptive inverse filtering, " Journal (Autumn) of Acoustical Society of Japan (ASJ), pp. 713-714, 2008).

SBM is an extended MINT which requires no pre-measurement of an acoustic transfer function from a sound source to a microphone (blind process), and can perform a reverberation reducing process with high precision only using a recorded signal. SBM is particularly effective for environments with few changes in the positions of microphones or sound sources, such as teleconference calls. However, since SBM computes filters in blocks of units, it requires time for adaptation, which makes it difficult to be used for applications where the positions of microphones or sound sources are greatly varied, such as auto-speech recognition in the robot hearing sense.

DAIF has been suggested to overcome such a problem of SBM. DAIF has high-speed adaptability since it performs a process in a sample-by-sample manner. However, since it updates coefficients based on an instantaneous correlation matrix, many errors occur in updating the coefficients, which leads to deterioration of performance of dereverberation process.

In prior dereverberation processes such as SBM and DAIF, since more channels generally provide a higher performance of dereverberation process, all available channels were used for the dereverberation process.

SBM and DAIF, which are common dereverberation methods, have a presumption that an initial arrival channel is known. When this presumption is not satisfied, noticeable deterioration of the dereverberation performance occurs as a result. If the position of a sound source can be limited to a defined range, such as in a teleconference call, an initial arrival channel can be known by means of the position of microphones.

SUMMARY OF THE INVENTION

However, since there exist channels with similar impulse responses depending on the arrangement of microphones, it cannot be necessarily said that more channels used provide higher performance. Specifically, if channels with similar transfer characteristics from a sound source to microphones are included, there may arise a problem of deterioration of dereverberation performance due to poor conditions of a matrix.

In addition, if a sound source may be anywhere such as with a robot hearing sense, it is difficult to presume an initial arrival channel.

To overcome the above problems, it is therefore an object of the present invention to provide a dereverberation apparatus and a dereverberation method which are capable of dereverberation without using a lot of channels.

It is another object of the present invention to provide a dereverberation apparatus and a dereverberation method which are capable of dereverberation even when an initial arrival channel is unknown.

To accomplish the above objects, according to a first aspect of the invention, there is provided a dereverberation apparatus including: a signal selecting unit (for example, a channel selecting unit $\mathbf{22}_j$ in an embodiment) which selects a sound signal to be used for dereverberation process from a plurality of sound signals; and a dereverberation processing unit (for example, a dereverberation processing unit $\mathbf{23}_j$ in an embodiment) which performs the dereverberation process for the selected sound signal. With this configuration, by selecting one or some of channels with similar transfer characteristics from a sound source to microphones, it is possible to reduce the number of channels without substantially deteriorating dereverberation performance.

According to a second aspect of the invention, in the first aspect of the invention, the signal selecting unit selects the sound signal based on an evaluation value related to dereverberation performance. With this configuration, by selecting an input sound signal based on the evaluation value related to dereverberation performance, it is possible to enhance a dereverberation effect.

According to a third aspect of the invention, in the first or second aspect of the invention, the dereverberation apparatus further includes a delay applying unit (for example, a delay applying unit 41 in an embodiment) which generates a delay applying completion signal by delaying at least one of the plurality of sound signals by a predetermined delay time, and the dereverberation processing unit performs the dereverberation process using the delay applying completion signal. With this configuration, even if an initial arrival channel is different from an assumed one, by applying a delay to an input signal other than a representative channel of a plurality of input signals, the representative channel can, without fail, become a channel at which the signal initially arrives (initial arrival channel).

According to a fourth aspect of the invention, in the third aspect of the invention, the dereverberation apparatus further includes a plurality of sound collectors (for example, a microphone $\mathbf{11}_j$ in an embodiment) which collects the sound signals, and the delay applying unit calculates the delay time based on a distance between the sound collectors. With this configuration, by calculating the delay time based on the distance between the sound collectors and applying the calculated delay time to an input signal other than a representative channel, the representative channel can, without fail, become an initial arrival channel.

According to a fifth aspect of the invention, there is provided a multi-stage dereverberation apparatus including: a plurality of dereverberation apparatuses (for example, a dereverberation unit $\mathbf{15}_1$, a dereverberation unit $\mathbf{15}_2$ or a dereverberation unit $\mathbf{15}_M$) according to the first aspect of the invention wherein the sound signal subjected to the dereverberation process by the dereverberation processing unit is output as a dereverberation signal, and the dereverberation signal output from the dereverberation processing unit of one dereverberation apparatus is input to the signal selecting unit of another dereverberation apparatus. With this configuration, by using a plurality of dereverberation signals obtained by different channel selections, it is possible to perform the dereverberation process in a recursive manner.

According to a sixth aspect of the invention, in the fifth aspect of the invention, the signal selecting unit selects the sound signal based on an evaluation value related to dereverberation performance. With this configuration, by selecting an input sound signal based on the evaluation value related to dereverberation performance, it is possible to enhance a dereverberation effect.

According to a seventh aspect of the invention, in the fifth or sixth aspect of the invention, the multi-stage dereverberation apparatus further includes a delay applying unit (for example, a delay applying unit 41 in an embodiment) which generates a delay applying completion signal by delaying at least one of the plurality of sound signals by a predetermined delay time, and the dereverberation processing unit performs the dereverberation process using the delay applying completion signal. With this configuration, even if an initial arrival channel is different from an assumed one, by applying a delay to an input signal other than a representative channel of a plurality of input signals, the representative channel can, without fail, become an initial arrival channel.

According to an eighth aspect of the invention, in the seventh aspect of the invention, the multi-stage dereverberation apparatus further includes a plurality of sound collectors (for example, a microphone $\mathbf{11}_j$ in an embodiment) which collects the sound signals, and wherein the delay applying unit calculates the delay time based on a distance between the sound collectors. With this configuration, by calculating the delay time based on the distance between the sound collectors and applying the calculated delay time to an input signal other than a representative channel, the representative channel can, without fail, become an initial arrival channel.

According to a ninth aspect of the invention, there is provided a dereverberation method including: a sound signal input step of inputting a plurality of sound signals; a signal selecting step of selecting a sound signal to be used for dereverberation process from the plurality of sound signals input in the sound signal input step; and a dereverberation processing step of performing the dereverberation process for the selected sound signal. With this configuration, it is possible to reduce the number of channels without substantially deteriorating dereverberation performance.

To accomplish the above objects, according to a tenth aspect of the invention, there is provided a dereverberation apparatus including: a delay applying unit (for example, a delay applying unit 41 in an embodiment) which generates a delay applying completion signal by delaying at least one of a plurality of sound signals by a predetermined delay time; and a dereverberation processing unit (for example, a dereverberation processing unit $\mathbf{23}_j$ in an embodiment) which performs a dereverberation process using the delay applying completion signal. With this configuration, by applying a delay to an input signal other than a predetermined representative channel, the representative channel can be set to a channel at which the sound signal initially arrives.

According to an eleventh aspect of the invention, in the tenth aspect of the invention, the dereverberation apparatus further includes a plurality of sound collectors (for example, a microphone $\mathbf{11}_j$ in an embodiment) which collects the sound signals, and the delay applying unit calculates the delay time based on a distance between the sound collectors. With this configuration, by calculating the delay time based on the distance between the sound collectors, a predetermined representative channel can be set to a channel at which the sound signal initially arrives.

According to a twelfth aspect of the invention, in the tenth aspect of the invention, the dereverberation apparatus further includes a sound source direction estimating unit (for example, a sound source direction estimating unit 141 in an embodiment) which estimates a sound source direction, and the delay applying unit calculates the delay time based on the sound source direction estimated by the sound source direction estimating unit. With this configuration, if the range of sound incoming direction is defined, a delay time to be applied to a signal can be determined based on the time providing the largest delay in the range.

According to a thirteenth aspect of the invention, in the tenth aspect of the invention, the dereverberation apparatus further includes: a plurality of sound collectors (for example, a microphone $\mathbf{11}_j$ in an embodiment) which collect the sound signals; and a sound source direction estimating unit (for example, a sound source direction estimating unit 141 in an embodiment) which estimates a sound source direction, and the delay applying unit calculates the delay time based on a distance between the sound collectors and the sound source direction estimated by the sound source direction estimating unit. With this configuration, if the estimation precision of the sound source direction is poor, delay time to be applied to a signal can be determined based on a result of estimation of the sound source direction and the distance between microphones.

According to a fourteenth aspect of the invention, there is provided a dereverberation method including: a sound signal input step of inputting a plurality of sound signals; a delay applying step of generating a delay applying completion signal by delaying at least one of a plurality of sound signals input in the sound signal input step by a predetermined delay time; and a dereverberation processing step of performing a dereverberation process using the delay applying completion signal.

According to the first aspect of the invention, by reducing the number of channels, it is possible to reduce hardware costs. In addition, it is possible to reduce time taken for the dereverberation process.

According to the second aspect of the invention, even if there is a limitation on the number of selectable channels, it is possible to select a combination of channels which is capable of obtaining a high dereverberation effect.

According to the third aspect of the invention, even if the initial arrival channel is different from an assumed one, it is possible to maintain performance of the dereverberation process.

According to the fourth aspect of the invention, since a proper delay time can be applied to an input signal other than a representative channel, it is possible to maintain performance of the dereverberation process.

According to the fifth aspect of the invention, even in a case where sufficient dereverberation performance cannot be obtained by a single process, it is possible to obtain high dereverberation performance.

According to the sixth aspect of the invention, even if there is a limitation on the number of selectable channels, it is possible to select a combination of channels which is capable of obtaining a high dereverberation effect.

According to the seventh aspect of the invention, even if the initial arrival channel is different from an assumed one, it is possible to maintain performance of the multi-stage dereverberation process.

According to the eighth aspect of the invention, since a proper delay time can be applied to an input signal other than a representative channel, it is possible to maintain performance of the multi-stage dereverberation process.

According to the ninth aspect of the invention, by reducing the number of channels, it is possible to reduce hardware costs. In addition, it is possible to reduce time taken for a dereverberation process.

According to the tenth aspect of the invention, since a predetermined representative channel can be set to a channel at which the sound signal initially arrives, it is possible to reduce reverberation with high precision even when an initial arrival channel is unknown.

According to the eleventh aspect of the invention, since a predetermined representative channel can be set to a channel at which the sound signal initially arrives, it is possible to reduce reverberation with high precision no matter which direction sound arrives from.

According to the twelfth aspect of the invention, since delay time can be determined according to a sound incoming direction signal, it is possible to reduce reverberation with high precision no matter which direction sound arrives from.

According to the thirteenth aspect of the invention, since delay time to be applied to a signal can be determined based on a result of estimation of the sound source direction and a distance between microphones, it is possible to reduce reverberation with high precision no matter which direction sound arrives from.

According to the fourteenth aspect of the invention, since a predetermined representative channel can be set to a channel at which the sound signal initially arrives, it is possible to reduce reverberation with high precision even when an initial arrival channel is unknown.

BRIEF DESCRIPTION OF THE DRAWINGS

FIG. 5 is a view for explaining a dereverberation process by MINT;

FIG. 6 is a block diagram of a configuration of a dereverberation processing unit by real-time DAIF;

FIG. 7 is a table showing measurement conditions of an impulse response;

DETAILED DESCRIPTION OF THE INVENTION

Hereinafter, embodiments of the present invention will be described in detail with reference to the accompanying drawings. In the related art, a dereverberation process was performed using all available channels since more channels generally provide higher dereverberation performance. However, since there may exist channels with similar acoustic transfer functions (hereinafter referred to as "impulse response") from a sound source to a microphone depending on arrangement of the microphone, it cannot be necessarily said that more channels provide higher dereverberation performance. Therefore, a first embodiment of the present invention performs a process of selecting the channels to be used (channel selection).

Figure 1:
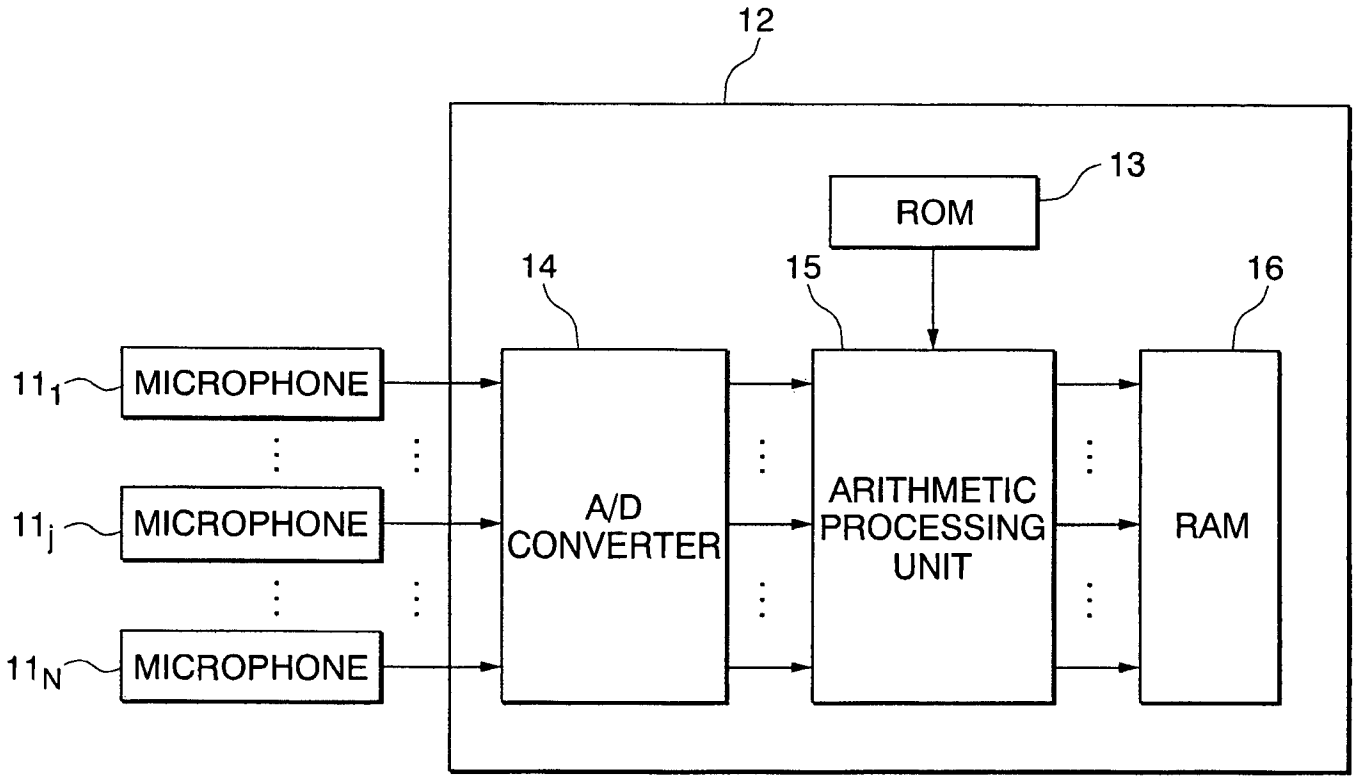
FIG. 1 is a block diagram of a configuration of a dereverberation apparatus according to an embodiment of the present invention.

FIG. 1 is a block diagram of a configuration of a dereverberation apparatus according to an embodiment of the present invention. The dereverberation apparatus includes a microphone $\mathbf{11}_j$ (j is an integer between 1 and N) and an electronic control unit 12. The electronic control unit 12 includes a ROM 13, an A/D converter 14, an arithmetic processing unit 15 and a RAM 16. The microphone $\mathbf{11}_j$ converts an input speech into an analog electrical signal which is then output to the A/D converter 14. The A/D converter 14 converts the electrical signal input from the microphone $\mathbf{11}_j$ into a digital signal. The A/D converter 14 outputs the digital signal to the arithmetic processing unit 15. The arithmetic processing unit 15 reads a control program from the ROM 12, performs a dereverberation operation for the digital signal input from the A/D converter 14 and writes a signal with reverberation reduced into the RAM 16.

Figure 2:
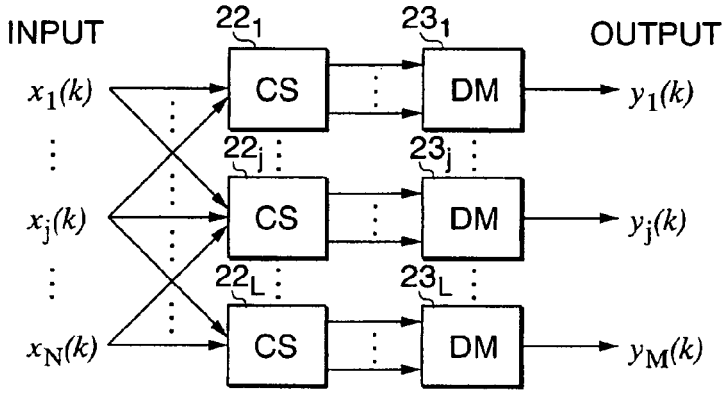
FIG. 2 is a block diagram of a configuration of an arithmetic processing unit of a dereverberation apparatus according to a first embodiment of the present invention.

FIG. 2 is a block diagram of a configuration of one embodiment (first embodiment) of the arithmetic processing unit 15 of the present invention. The arithmetic processing unit 15 includes a channel selecting unit (CS) $\mathbf{22}_j$ and a dereverberation processing unit (DM) $\mathbf{23}_j$.

The channel selecting unit (CS) $\mathbf{22}_j$ selects a plurality of channels from a speech signal $x_j$ (j is an integer between 1 and L) input from the A/D converter 14. The channel selecting unit $\mathbf{22}_j$ outputs the selected channels to the dereverberation processing unit (DM) $\mathbf{23}_j$ (j is an integer between 1 to L).

The dereverberation processing unit (DM) $\mathbf{23}_j$ performs a dereverberation process for an input signal and outputs a signal $y_j$ (j is an integer between 1 to N) with reverberation reduced to the RAM 16 in which the signal $y_j$ with reverberation reduced is stored.

As shown in FIG. 2, the channel selecting unit $\mathbf{22}_j$ selects the predetermined number of channels from N inputs and outputs the selected channels to the dereverberation processing unit $\mathbf{23}_j$.

Figure 3:
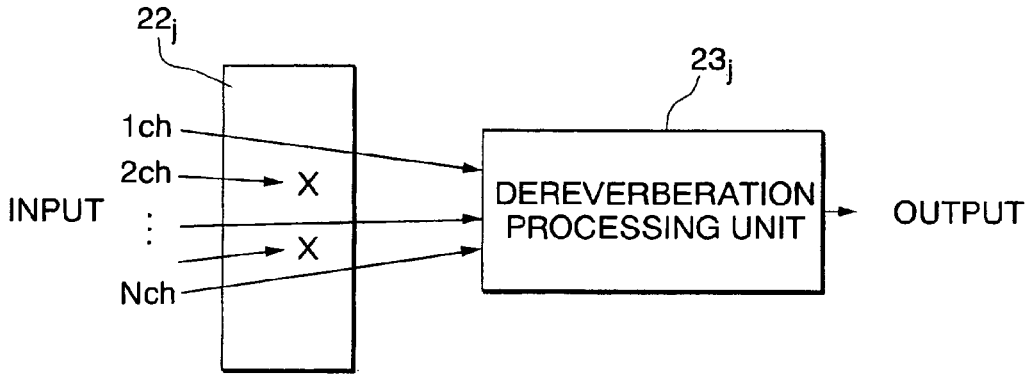
FIG. 3 is a view for explaining a process of a channel selecting unit.

In the related art, a dereverberation process was performed using all available channels since more channels generally provide higher dereverberation performance. However, since there may exist channels with similar acoustic transfer functions (hereinafter referred to as "impulse response") from a sound source to a microphone depending on arrangement of the microphone, it cannot be necessarily said that more channels provide higher dereverberation performance. In this embodiment, a process of selecting channels to be used (channel selection) is performed before the dereverberation processing unit (DM) $\mathbf{23}_j$ performs the dereverberation process. The process of the channel selecting unit will be described below with reference to FIG. 3. The channel selecting unit $\mathbf{22}_j$ selects only the predetermined number of channels from N inputs and outputs the selected channels to the dereverberation processing unit $\mathbf{23}_j$. This process can reduce the number of channels without substantially deteriorating a dereverberation performance. The reduction of the number of channels is an effective way to reduce hardware costs.

SBM and DAIF have the presumption that an initial arrival channel is known. Therefore, if this condition is not satisfied, that is, if the initial arrival channel is different from the presumption, the dereverberation performance is remarkably deteriorated. If a position of a sound source such as a teleconference call can be limited to a defined range, the initial arrival channel can be known in consideration with a microphone position. However, when a sound source, such as with a robot hearing sense, may be anywhere, it is difficult to presume the initial arrival channel. In this embodiment, to avoid this difficulty, a delay is applied to an input signal other than a representative channel of a plurality of input channels, so that the representative channel becomes an initial arrival channel without fail. In this embodiment, a time longer than the time taken for propagation over a distance between the farthest microphones is set as the delay time.

Figure 4:
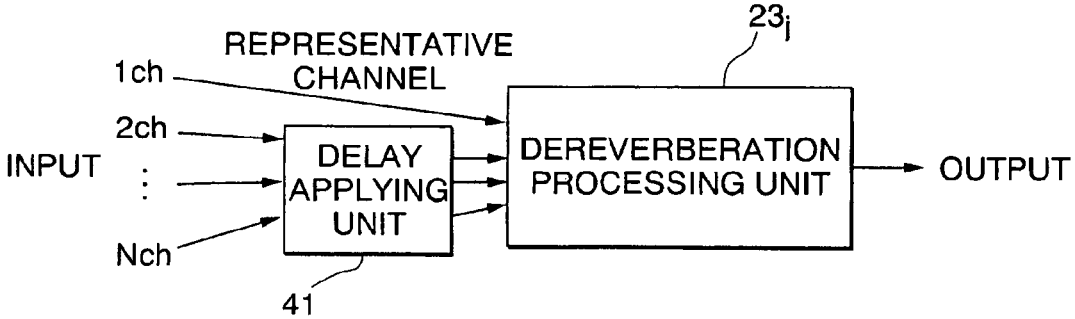
FIG. 4 is a view for explaining a process of a delay applying unit.

A process of a delay applying unit will be described below with reference to FIG. 4. As shown in FIG. 4, a delay applying unit 41 applies a delay to selected channels 2*ch* to Nch (N is an integer equal to or more than 2) other than a representative channel 1*ch* of N signals input from the A/D converter 14. The delay applying unit 41 outputs the delayed signals to the dereverberation processing unit $\mathbf{23}_j$.

The dereverberation processing unit $\mathbf{23}_j$ applies a dereverberation filter to the input delayed signals to output a dereverberation-filtered signal. Here, details of the process of the dereverberation processing unit $\mathbf{23}_j$ will be described. First, prior to description of a filtering process of SBM, MINT (see, for example, M. Miyoshi and Y. Kaneda, "Inverse filtering of room acoustics," IEEE Transactions on Speech and Audio Processing, Vol. 36, No. 2, pp. 145-152, 1988), which is the basis for SBM, will be described. MINT is a theorem which clarifies conditions for implementing a precise reverse filter with a FIR filter. According to MINT, in a case where signals propagated from M sound sources are observed at N points, in order to reproduce sound source signals from the observed signals precisely, it is required that N>M and transfer functions from the sound sources to the observation points have no common zero point. In this embodiment, since it is assumed that the number of sound sources as objects of dereverberation is one, description will be given with the number of decreased sounds limited to one in the later formulization.

FIG. 5 is a view for explaining a dereverberation system using N microphones Mic. In the figure, s(k) represents a sound source signal, k represents discrete time, $g_j(k)$ represents an indoor impulse response (known) with length K from a sound source to a j-th microphone, N represents the number of microphones (N>1), $x_j(k)$ (j=1, N) represents a received sound signal at the j-th microphone, $h_j(k)$ represents a FIR filter (unknown) with length L constituting an inverse filter of $g_j(k)$, and y(k) represents an inverse filter output. Expressing z transformation of $g_j(k)$ and $h_j(k)$ as $G_j(z)$ and $H_j(z)$, respectively, the following equation (01) has to be satisfied in order to constitute a precise inverse filter.

$$G_1(z)H_1(z)+G_2(z)H_2(z)+,\ldots,+G_N(z)H_N(z)=1 \tag{01}$$

The above equation (01) is an indeterminate equation with a plurality of solutions, which is also called a Diophantine equation. When expressed by a matrix using coefficients (impulse response values) of a z polynomial expression, the equation (01) may be expressed as the following equation (02).

$$D=GH \tag{02}$$

Where, G represents a matrix of (K+L−1)×NL expressed as the following equation (03), H represents a column vector of NL rows expressed as the following equation (04), and D represents a column vector of $[10,\ldots,0]^T$.

$$G=[G_1,\ldots,G_N] \tag{03}$$

$$H=[h_1,\ldots,h_N]^T \tag{04}$$

Where, $G_j$ represents a convolution matrix with $g_j$ as an element, and $g_i$ and $h_j$ are expressed as the following equations (05) and (06), respectively (see OGA Tanetoshi, YAMAZAKI Yoshio and KANEDA Yutaka, "Sound System and Digital Processing," Corona Company, 1995).

$$g_j=[g_j(0),\ldots,g_j(K-1)]^T \tag{05}$$

$$h_j=[h_j(0),\ldots,h_h(L-1)]^T \tag{06}$$

When the matrix G is known by measurement or the like, a coefficient H of the inverse filter can be obtained from the inverse matrix of the matrix G, as expressed by the following equation (07).

$$H=G^{-1}D \tag{07}$$

For existence of an inverse matrix of the matrix G, it is necessary that condition (A): K+L−1=NL, and condition (B): $|G|\neq 0$ be satisfied. In addition, two conditions represented by MINT, i.e., (1) constraint on the number N of inverse filters (=the number of microphones) and coefficient length L and (2) the absence of a common zero in transfer systems, are derived from the above conditions (A) and (B).

Next, SBM is described below. Due to the constraint on MINT that a transfer function of a target system is known, there is a need to measure the transfer function prior to application. However, in many cases, it is actually difficult to measure the transfer function prior to application, which was a problem to be overcome for application. SBM provides a solution to overcome this problem by presuming the following conditions (a) and (b).

(a) A sound source is a white signal (a colored sound source such as a speech or the like may be used by subjecting it to a whitening process).

(b) A channel at which sound emitted from the sound source first arrives (initial arrival channel) is known.

Next, a filter process of SBM in a filter processing unit 42 will be described below. The filter processing unit 42 applies an inverse filter H to an input signal X and writes the signal applied with the inverse filter H into the RAM 16. The inverse filter H is expressed as the following equation (08) from a correlation matrix R of the input signal X (see FURUYA Kenichi and KATAOKA Akitoshi, "Semi-blind dereverberation using an interchannel correlation matrix and a whitening filter," Technology Research Report of The Institute of Electronics, Information and Communication Engineers (IEICE), Vol. J88-A, No. 10, pp. 1089-1099, 2005).

$$H=g_1(0)R^{-1}D \tag{08}$$

In computation of the above equation (08), SBM with the amount of computation reduced by using a Fast Fourier Transform (FFT) and a Conjugate Gradient (CG) (FFT-CG-SBM) is used (see FURUYA Kenichi and KATAOKA Akitoshi, "Real-Time dereverberation process for receipt of remote speech," Technology Research Report of The Institute of Electronics, Information and Communication Engineers (IEICE), Vol. 105, No. 9, pp. 13-18, 2005)

Subsequently, in a case of processing by the Real-time DAIF (RDAIF), as shown in the block diagram of FIG. 6, the dereverberation processing unit (DM) $\mathbf{23}_j$ includes an inverse filter processing unit 62 and an inverse filter calculating unit 63.

The inverse filter processing unit 62 applies an inverse filter H(k) to an input signal x(k), outputs a signal y(k) applied with the inverse filter to the inverse filter calculating unit 63, and writes the signal y(k) into the RAM 16.

The inverse filter calculating unit 63 calculates an inverse filter H(k+1) of the next step based on the signal x(k) input from the channel selecting unit $\mathbf{22}_j$ or the delay applying unit 41 (if any) and the signal y(k) input from the inverse filter processing unit 62 and outputs the calculated inverse filter H(k+1) to the inverse filter processing unit 62.

Subsequently, a method of calculating the inverse filter H will be described below. DAIF is a method for designing an inverse filter adaptively based on decorrelation of an input and an output. This method is based on a theorem to ease the condition on MINT, (A) K+L−1=NL, using a pseudo-inverse matrix. Accordingly, the above-described conditions (a) and (b) are presumed as in the case of SBM. In addition, if a filter length is determined based on MINT, this method is theoretically equivalent to a method of obtaining SBM using a steepest descent method. Assuming that a scale factor $g_1(0)$ as 1 for the purpose of simplicity, an error of the equation (08) is expressed as the following equation (09).

$$E=D-RH \tag{09}$$

DAIF finds H to minimize the Frobenius norm of E using a gradient method adaptively according to the following equations (10) and (11).

$$H(k+1)=H(k)-\mu J'(k) \tag{10}$$

$$J'(k)=-R(k)(D-R(k)H(k)) \tag{11}$$

Where, μ represents a step-size parameter.

RDAIF (Real-time DAIF) is a method of modifying a matrix operation of the equation (11) for DAIF to a vector operation under the following two presumptions to significantly reduce the memory capacity used and the amount of computation. RDAIF has the presumptions expressed as the following equations (12) and (13).

$$R^T(k)R(k)\approx E\{x(k)x^T(k)x(k)x^T(k)\} \tag{12}$$

$$R(k)H(k)=E\{x(k)x^T(k)\}H(k)\approx E\{x(k)y^T(k)\} \tag{13}$$

Where, E{x(k)} represents an expectation value of x(k). RDAIF reduces the amount of computation by modifying all the matrixes of the equation (11) to vectors as expressed as the following equation (14).

$$J'(k)=-E\{x(k)x(k)\}+E\{x(k)|x(k)|^2y^T(k)\} \tag{14}$$

Subsequently, a result of an evaluation experiment will be described in order to confirm the effectiveness of the dereverberation of this embodiment. First, experiment conditions will be described. The process of the dereverberation processing unit $\mathbf{23}_j$ used FFT-CG-SBM and RDAIF which are methods which can be used even in a case where an impulse response length of a transfer system is long. (1) Impulse response of a transfer system, (2) sound source signal, (3) evaluation value of dereverberation performance, and (4) parameters are as follows.

Figure 8A:
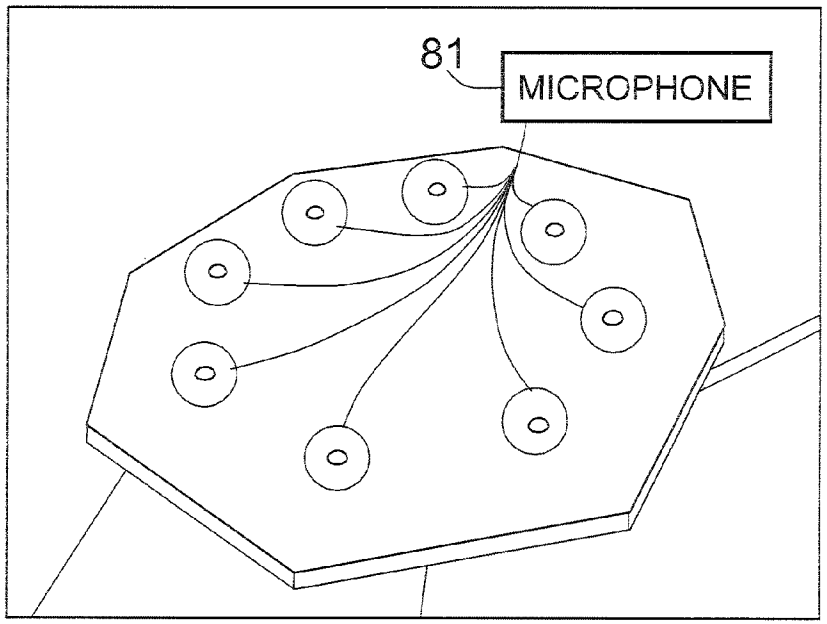
FIG. 8A is a view for explaining arrangement of a microphone.
Figure 8B:
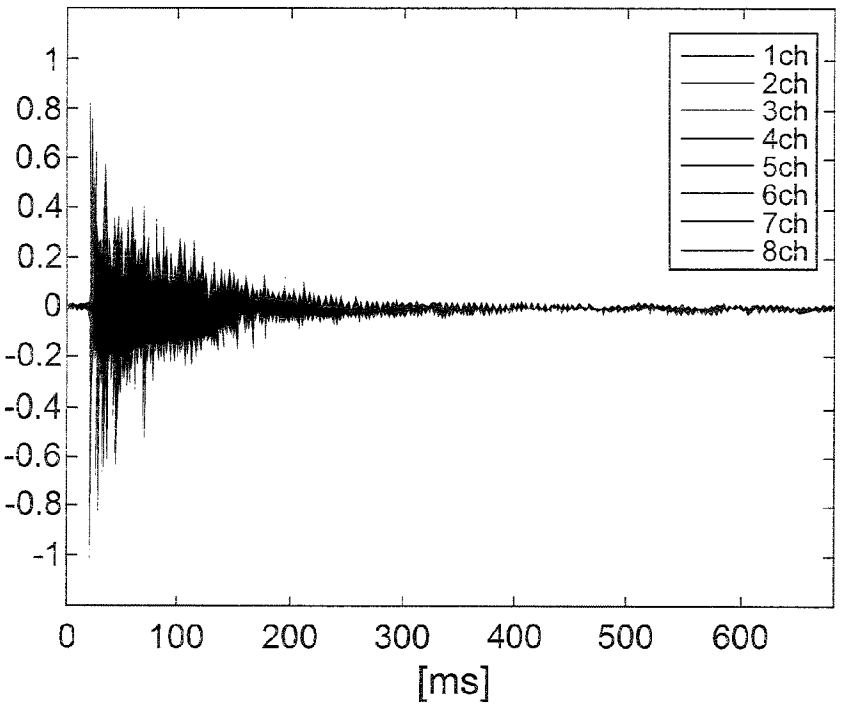
FIG. 8B is a view for explaining an impulse response waveform.

(1) The impulse response of the transfer system was prepared by processing measured data. Measurement conditions are as shown in FIG. 7. FIG. 8A is a view showing installation positions of microphones 81 of 8 channels. In FIG. 8A, positions of the microphones 81 are indicated by circles. For use of the impulse response of the transfer system, a waveform obtained by cutting a measured impulse response into 2048 samples (667 ms) was used. FIG. 8B is an enlarged view of an initial portion of an impulse response waveform of the transfer system. In FIG. 8B, a horizontal axis represents time and a vertical axis represents amplitude. FIG. 8B shows superposition of all 8 channels with different light and shade. Each channel has a waveform converging on 500 ms or so.

(2) The sound source signal was assumed as white Gaussian noise with an average of 0 and a variance of 1, and an input signal to a microphone for evaluation was prepared by convolving an impulse response. A signal length for evaluation was assumed as 217 samples.

(3) Subsequently, an evaluation value of dereverberation performance will be described. Reverberation is divided into initial reflection sound with lower diffusivity and later reverberation sound with higher diffusivity. SBM and RDAIF dealt with in this embodiment employ a dereverberation system based on an inverse filter and are thus effective in reducing the initial reflection sound. Accordingly, in this embodiment, the amount of reduction of the initial reflection sound ranging from 5 to 50 ms was assumed as an evaluation value. With a range of 0 to 5 ms of a response assumed as direct sound and a range of 5 to 50 ms of the response assumed as the initial reflection sound, the evaluation value is calculated using initial reflection energy $LD_5$ dB which is normalized to signal energy up to 50 ms.

$$LD_5 = 10\log_{10}\left(\frac{\int_{5\times10^{-3}}^{50\times10^{-3}} g^2(\tau)d\tau}{\int_0^{50\times10^{-3}} g^2(\tau)d\tau}\right) \quad (15)$$

Where, $\tau(s)$ represents time and $g(\tau)$ represents an impulse response waveform. The denominator in $\log_{10}$ represents total energy (sum of energy of the direct sound and energy of the initial reflection sound) and the numerator in $\log_{10}$ represents energy of the initial reflection sound.

The evaluation value is defined as a dereverberation rate (RRR) dB, which is a ratio of $LD_5$ before dereverberation and $LD_5$ after dereverberation, according to the following equation.

$$RRR = LD_{5b} - LD_{5a} \quad (16)$$

Where, $LD_{5b}$ represents initial reflection energy before dereverberation and $LD_{5a}$ represents initial reflection energy after dereverberation. In addition, RRR=0 dB means that the amount of reverberation evaluated by $LD_5$ is invariant, and the larger RRR, the higher the amount of reverberation.

(4) Subsequently, parameters used for the experiment will be described. A normalization coefficient $\Delta$ in inverse matrix calculation in FFT-CG-SBM is assumed as 1/100 of the maximum of an absolute value of a matrix element and a step size $\mu$ in RDAIF is assumed as 1/10 of an optimal value obtained by an Adaptive Step Size parameter. A filter length is determined for both methods based on MINT.

Figure 9:
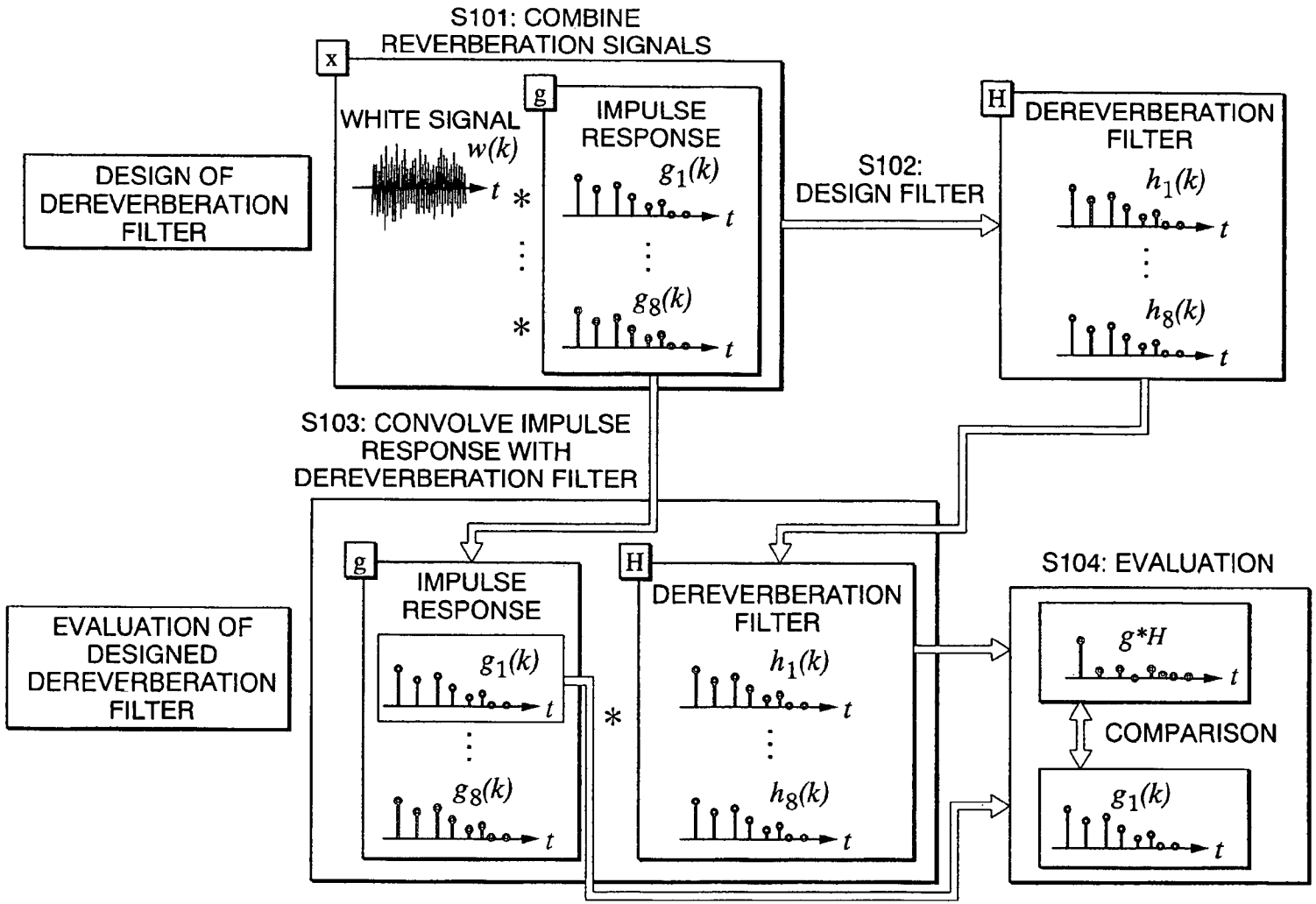
FIG. 9 is a view for explaining an experiment order.

Subsequently, an experiment order will be described. As shown in FIG. 9, a two-step experiment including design of a dereverberation filter and an evaluation of the designed filter is made to evaluate dereverberation performance. First, for the design of dereverberation filter, a reverberation signal is prepared by convolving an impulse response g with a white signal w (Step S101). Next, a dereverberation filter h is computed from the reverberation signal using SBM and DAIF (Step S102).

Next, for the evaluation of the designed dereverberation filter, the designed dereverberation filter h is convolved with the original impulse response g (Step S103). Next, the convolution g*h of the reverberation-reduced impulse response with the original impulse response g is used to calculate normalized initial reflection energy $LD_5$ and then the dereverberation rate (RRR) (Step S104).

Figures 10, 11:
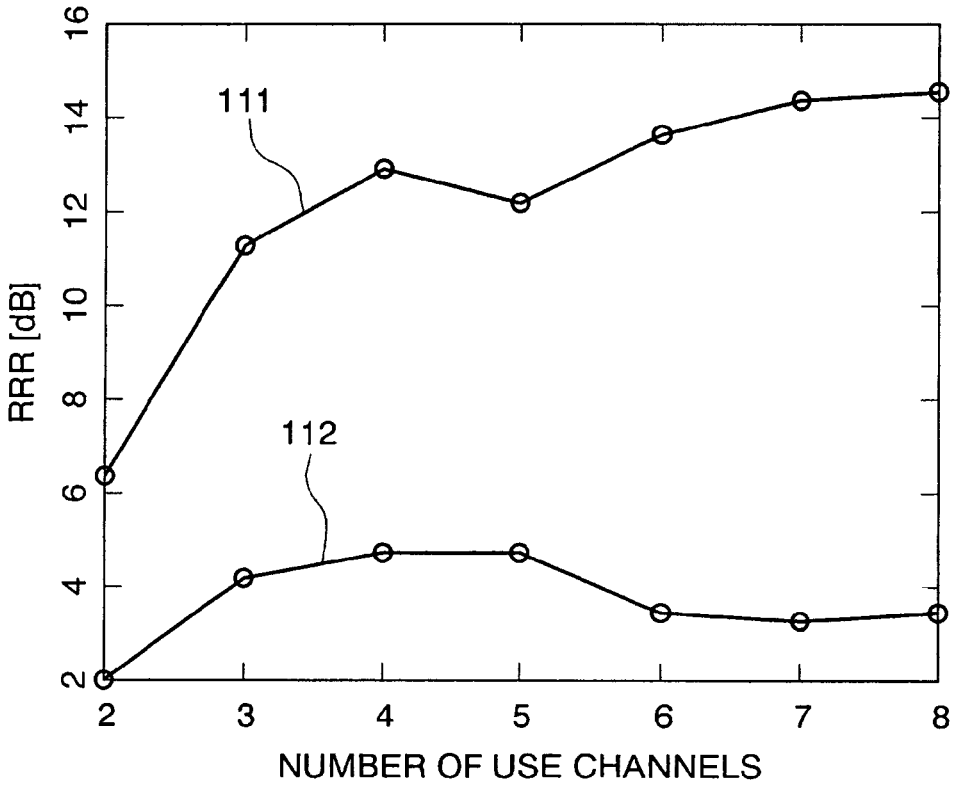
FIG. 10 is a table showing the number of channels used in an experiment and channels used.
FIG. 11 is a view for explaining a relationship between the number of channels used and the amount of dereverberation.

Subsequently, an experiment result will be described. First, an experiment was made to catch the number of microphones and the tendency of dereverberation performance. In this experiment, two representative channels were initially selected, a use channel was added to each representative channel, and the dereverberation rate (RRR) was evaluated when 2 to 8 channels were used, as shown in FIG. 10. FIG. 11 shows a result of the evaluation as a relationship between the number of channels and the dereverberation rate. In this figure, a horizontal axis represents the number of channels and a vertical axis represents the dereverberation rate (RRR). As shown in the same figure, for FFT-CG-SBM 111, although the number of channels and the dereverberation performance tend to substantially monotonously increase, the dereverberation performance becomes deteriorated when the channel increases from channel 4 to channel 5. For RDAIF 112, channel 4 shows higher performance than channel 8.

As described above, the number of channels can be reduced without substantially deteriorating the dereverberation performance. In addition, it is apparent that the channel selection contributes to a reduction of hardware costs as well as improvement of performance.

Next, an evaluation experiment for the process of selecting an optimal channel was made. In this experiment, the number of selected channels was 3 when specified by a user. Here, a combination of selections of optimal channels is a combination of channels showing the highest performance in an exhaustive search (performance evaluation for all combinations). The total number of combinations is ${}_8P_3$ (=336).

Figure 12:
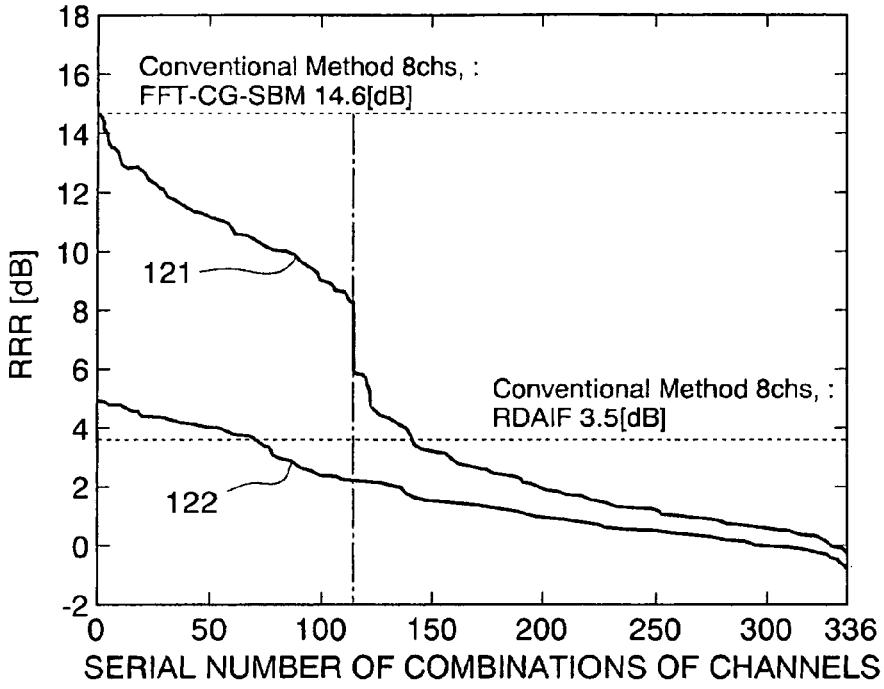
FIG. 12 is a view for explaining the amount of dereverberation for combinations of all channels.

FIG. 12 shows a relationship between the combinations of channels and the dereverberation rate. In this figure, a horizontal axis represents serial numbers of combinations of channels of microphones and a vertical axis represents RRR. The serial numbers are arranged in an ascending order of dereverberation rate (value on the vertical axis). A horizontal dashed line represents performance when 8 channels are used (in the prior art). It can be seen from FIG. 12 that FFT-CG-SBM 121 shows a performance difference equal to or more than 12 dB and RDAIF 122 shows a performance difference equal to or more than 4 dB for the combinations of channels.

When the optimal combination (the leftmost) is selected in this process, FFT-CG-SBM which used 3 channels obtains substantially the same dereverberation performance as the prior art which used 8 channels and RDAIF obtains dereverberation performance higher by about 1.5 dB than that in the prior art. As described above, it was confirmed that this embodiment is more effective in reducing the number of channels without deteriorating the dereverberation performance. In addition, it can be seen from the same figure that a boundary (vertical dashed line) of a combination in which RRR of FFT-CG-SBM 121 steeply decreases is a boundary between a combination which satisfies the condition that an initial arrival channel is known and a combination which cannot satisfy the same condition and the dereverberation performance is remarkably deteriorated when the same condition cannot be satisfied.

Next, a result of an experiment in which a delay applying process is performed in order to mitigate the condition that the initial arrival channel is known will be described. In this experiment, a delay was applied to two signals other than a representative signal among 3 channel signals selected in the channel selecting process.

In this embodiment, time longer than time taken for propagation over a distance between the farthest microphones is set as delay time. A method of calculating the delay time is as follows. Microphones are arranged in the form of a circle with a diameter of 0.3 m and accordingly the maximum distance between the microphones is 0.3 m. Considering the velocity of sound is about 300 m/s, the time it takes for sound to propagate over the maximum distance between the microphones is 0.3 (m)/300 (m/s) (=0.001 s=1 ms). In order to prevent the start time of signals from being coincident between the microphones, a small delay time of 0.5 ms is added to 1 ms, so that delay time applied to one of the two signals other than the representative signal can be 1.5 ms. In addition, delay time applied to the remaining signal is set to be 3 ms which is twice as long as 1.5 ms. In addition, delay times applied to the two signals other than the initial arrival channel may be theoretically equal to each other.

Figure 13:
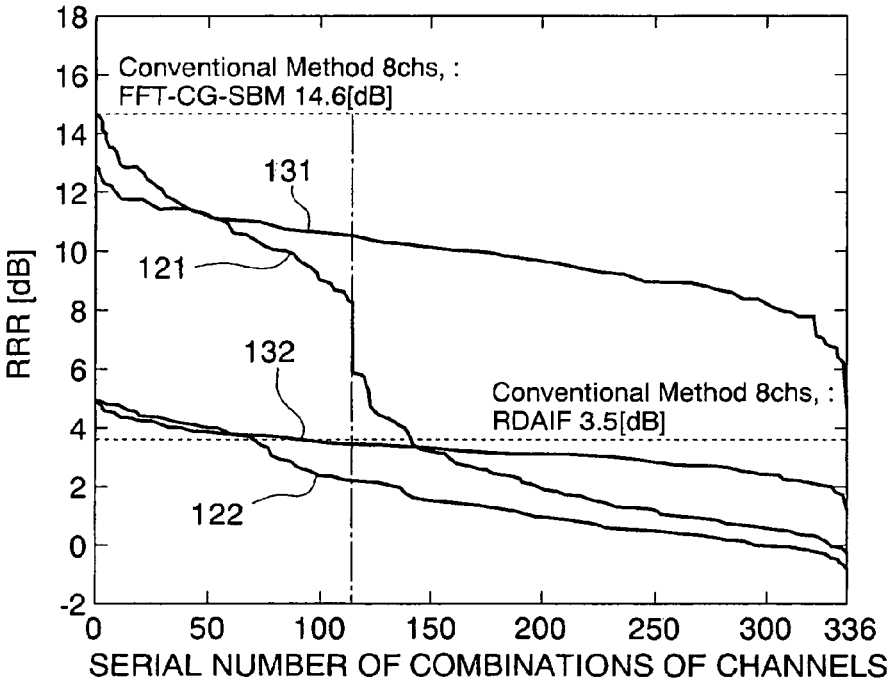
FIG. 13 is a view for explaining the amount of dereverberation for combinations of all channels when a delay is applied.

FIG. 13 shows a change of the dereverberation performance due to a delay application. In this figure, vertical and horizontal axes are the same as those in FIG. 12, thick lines represent a result of no delay application (the same as that in FIG. 12) and thin lines represent a result of delay application. It can be seen from the same figure that the delay application (for example, FFT-CG-SBM delay 131) provides performance substantially higher than no delay application (for example, FFT-CG-SBM 121). In particular, for FFT-CG-SBM 121, a combination which did not satisfy the condition of the initial arrival channel shows high performance improvement of equal to or more than 6 dB. In addition, in comparison to RDAIF 122, RDAIF delay 132 shows performance improvement for about 70% of combinations while showing a low degree of deterioration in combinations with deteriorated performance.

As described above, even in a case where the initial arrival channel is not known, a dereverberation process can be performed using FFT-CG-SBM or RDAIF by applying the delay. In addition, it is possible to further improve the performance of the dereverberation process with more channel combinations.

Figure 14:
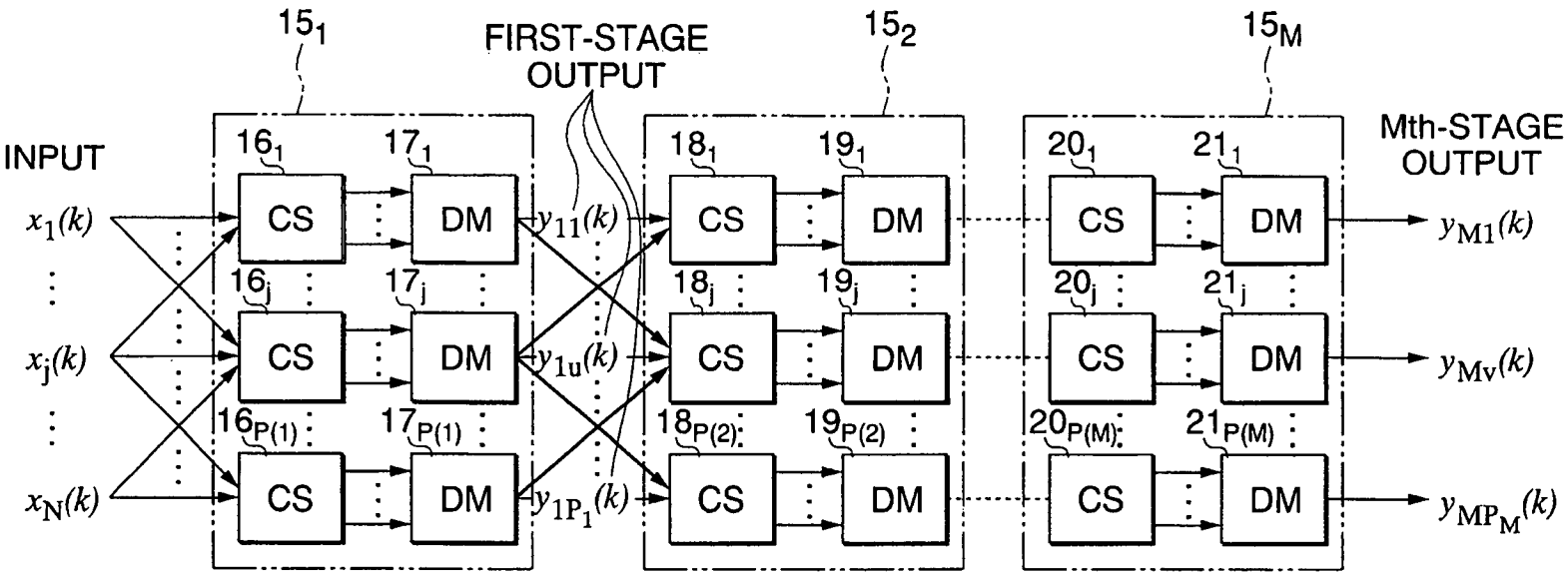
FIG. 14 is a block diagram of a configuration of an arithmetic processing unit of a dereverberation apparatus according to a second embodiment of the present invention.

Next, a multi-stage dereverberation apparatus according to a second embodiment of the present invention will be described. A multi-stage dereverberation process refers to performing a dereverberation process in a recursive manner using a plurality of dereverberation signals obtained by different channel selections. According to this process, it can be expected to obtain high dereverberation performance even in a case where sufficient dereverberation performance cannot be obtained by a single process. FIG. 14 is a block diagram of a configuration of an arithmetic processing unit 15 of the multi-stage dereverberation apparatus. The multi-stage dereverberation apparatus includes M (M is a positive integer) dereverberation units $\mathbf{15}_1, \mathbf{15}_2, \ldots, \mathbf{15}_M$.

A first-stage dereverberation unit $\mathbf{15}_1$ includes a first-stage channel selecting unit (CS) $\mathbf{16}_j$ (j is an integer between 1 and P(1)) and a first-stage dereverberation processing unit (DM) $\mathbf{17}_j$ (j is an integer between 1 and P(1)).

A second-stage dereverberation unit 152 includes a second-stage channel selecting unit (CS) $\mathbf{18}_j$ (j is an integer between 1 and P(2)) and a second-stage dereverberation processing unit (DM) $\mathbf{19}_j$ (j is an integer between 1 and P(2)).

An $M^{th}$-stage dereverberation unit 15M includes an $M^{th}$-stage channel selecting unit (CS) $\mathbf{20}_j$ (j is an integer between 1 and P(M)) and an $M^{th}$-stage dereverberation processing unit (DM) $\mathbf{21}_j$ (j is an integer between 1 and P(M)).

The channel selecting unit $\mathbf{16}_j$ selects the predetermined number of input signals from N input channel signals input from the A/D converter 14 and outputs the selected input signals to the dereverberation processing unit. The dereverberation processing unit $\mathbf{17}_j$ applies a dereverberation filter to the signals input from the channel selecting unit $\mathbf{16}_j$ and outputs filtered signals $y_{1u}(k)$ (u is an integer between 1 and P(1)), as a first-stage output, to the second-stage channel selecting unit (CS) $\mathbf{18}_j$.

The second-stage channel selecting unit (CS) $\mathbf{18}_j$ selects the predetermined number of input signals from P(1) reverberation-reduced signals $y_{1u}(k)$ (u is an integer between 1 and P(1)) input from the dereverberation processing unit 17*j* and outputs the selected signals to the dereverberation processing unit $\mathbf{19}_j$ (j is an integer between 1 and P(2)).

The dereverberation processing unit $\mathbf{19}_j$ (j is an integer between 1 and $P_2$) applies a dereverberation filter to the signals input from the channel selecting unit (CS) $\mathbf{18}_j$ and outputs filtered signals to the third-stage channel selecting unit (CS). In the multi-stage dereverberation apparatus, the third to $(M-1)^{th}$ dereverberation units perform the process as described above.

Finally, the $M^{th}$-stage channel selecting unit (CS) $\mathbf{20}_j$ (j is an integer between 1 and $P_M$) selects the predetermined number of signals from P(M−1) reverberation-reduced signals input from the $(M-1)^{th}$-stage dereverberation unit and outputs the selected signals to the dereverberation processing unit $\mathbf{21}_j$ (j is an integer between 1 and P(M)).

The $M^{th}$-stage dereverberation processing unit $\mathbf{21}_j$ (j is an integer between 1 and P(M)) applies a dereverberation filter to the signals input from the $M^{th}$-stage channel selecting unit (CS) $\mathbf{20}_j$ (j is an integer between 1 and P(M)) and outputs a filtered signal, as an $M^{th}$-stage output signal $y_{Mv}(k)$ (v is an integer between 1 and P(M)), to the RAM 16 in which the output signal $y_{Mv}(k)$ is stored.

Figure 15:
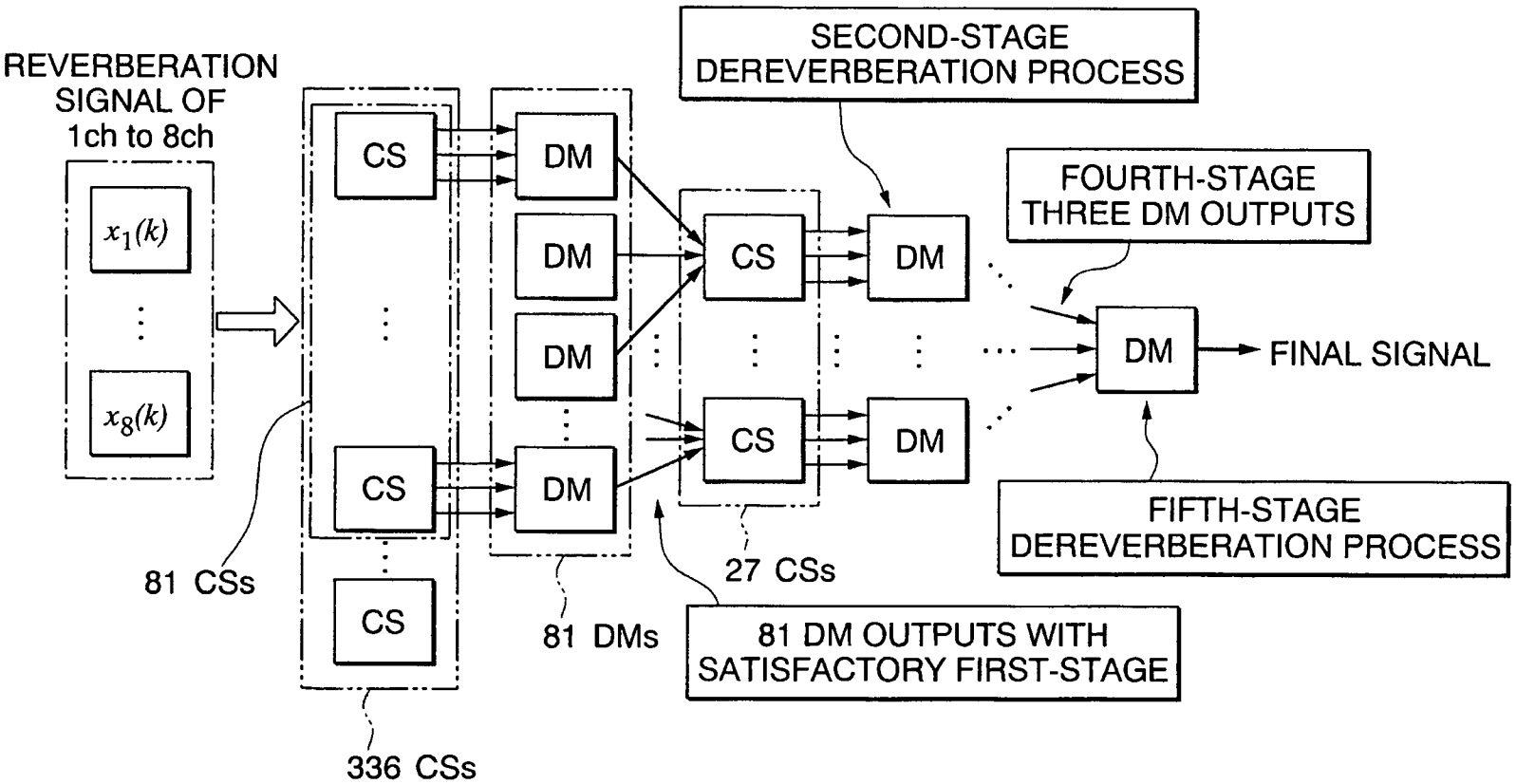
FIG. 15 is a view for explaining a multi-stage dereverberation process used in an experiment.

A result of the experiment to verify the effectiveness of the multi-stage dereverberation process will be described below. The number of process stages is set to be 5 and the number of input channels of each processing module at each stage is set to be 3. A stage connection scheme has a pyramidal structure as shown in FIG. 15.

The first-stage channel selecting unit (CS) selects the upper 81 combinations of all 336 combinations and outputs the selected combinations to the first-stage dereverberation processing unit DM. The first-stage dereverberation processing unit DM reduces reverberation of input signals and outputs the reverberation-reduced signal to the second-stage channel selecting unit (CS).

The second-stage and later channel selecting units (CS) each select three outputs of the first-stage dereverberation processing units (DM) at random and output the selected outputs to the second-stage dereverberation processing unit (DM). The second-stage and later dereverberation processing units (DM) each reduce reverberation of input signals and output the reverberation-reduced signal to the next-stage channel selecting unit (CS).

Finally, the fifth-stage dereverberation processing unit (DM) which receives outputs of the fourth-stage 3 dereverberation processing units (DM) writes a final signal into the RAM 16.

Figure 16:
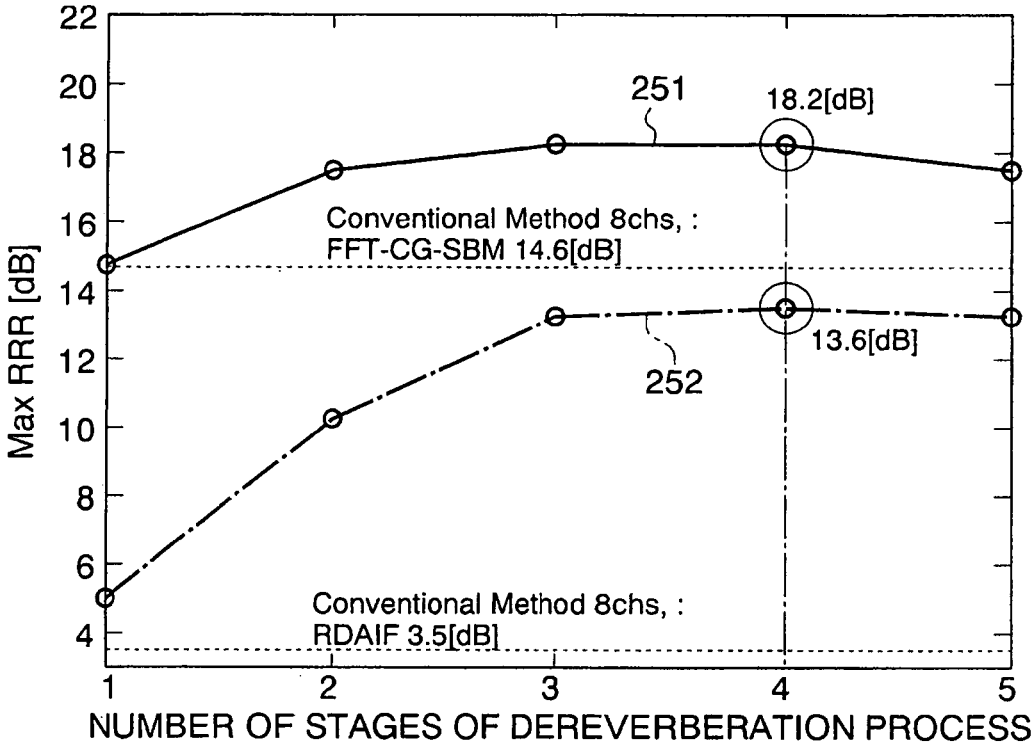
FIG. 16 is a view for explaining a relationship between the number of stages of a dereverberation process and the amount of dereverberation.

FIG. 16 shows a relationship between the number of stages and the maximum value of RRR. In this figure, horizontal dashed lines represent performance achieved by conventional methods (single process using 8 channels). It can be seen from the same figure that the increased number of stages can improve the performance of FFT-CG-SBM 251 and RDAIF 252. However, performance improvement is remarkable up to the third stage but is nearly saturated from later stages. In addition, it is believed that a small decrease of RRR at the final stage is derived from computational errors. It can be seen from the same figure that the multi-stage dereverberation process is particularly more effective with RDAIF 252. Paying attention to the fourth-stage of FIG. 17 in which the maximum performance can be obtained, both methods achieve high dereverberation rates (RRR), 18.2 dB for FFF-CG-SBM and 13.6 dB for RDAIF. In comparison to the prior art (single process using 8 channels), FFT-CG-SBM and RDAIF can achieve further improvement in dereverberation by 3.6 dB and 10.1 dB, respectively.

Figure 17:
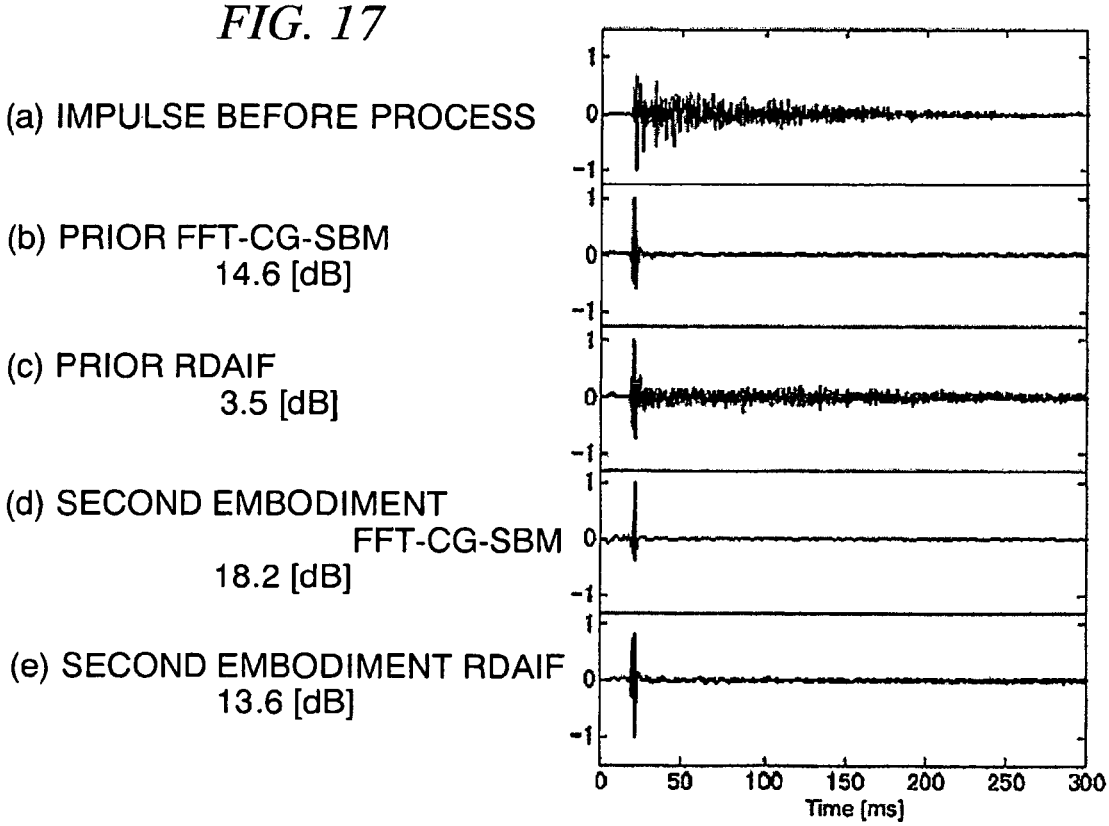
FIG. 17 is a view for explaining a comparison of impulse response from a sound source to an output between the related art and the second embodiment.

FIG. 17 shows a comparison in impulse response from a sound source to an output between the related art and the method of the second embodiment. In FIG. 17, parts (a) to (e) represent an impulse response before the dereverberation process is performed, an impulse response from a sound source to an output using the prior FFT-CG-SBM, an impulse response from a sound source to an output using the prior RDAIF, an impulse response from a sound source to an output using the multi-stage FFT-CG-SBM of the second embodiment, and an impulse response from a sound source to an output using the multi-stage RDAIF of the second embodiment, respectively. In addition, an inverse filter of the second embodiment can obtain the best dereverberation rate (RRR) at the fourth stage. In the same figure, a horizontal axis represents time and a vertical axis represents amplitude.

In comparison with the waveform before the dereverberation process is performed (part (a) in FIG. 17), it can be confirmed that all methods perform the correct dereverberation process as a response approaches a pulse. For FFT-CG-SBM, in comparison of the prior method (part (b) in FIG. 17) with multi-stage FFT-CG-SBM (part (d) in FIG. 17), it can be confirmed that a pulse width becomes narrow to further improve the performance. For RDAIF, it can be confirmed that part (d) in FIG. 17 showing a result of application of the multi-stage RDAIF is more effective as it shows a signal as pulsatory as that in the prior FFT-CG-SBM while the prior method (part (c) in FIG. 17) leaves much reverberation.

As described above, with the multi-input dereverberation process assumed as one processing module, it is possible to achieve high dereverberation performance by connecting a plurality of processing modules with different input channels in a cascading manner.

Figure 18:
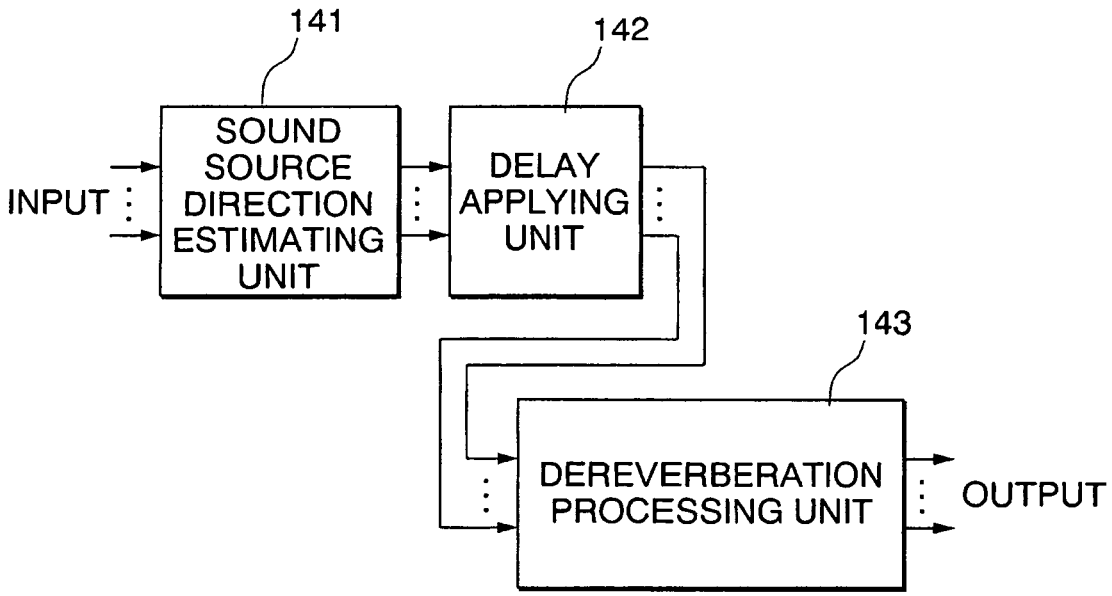
FIG. 18 is a block diagram of a configuration of an arithmetic processing unit of a dereverberation apparatus according to a third embodiment of the present invention.

Subsequently, a method of calculating delay time applied to a signal according to a third embodiment will be described with reference to the related figure. FIG. 18 is a block diagram of a configuration of an arithmetic processing unit 15 of a dereverberation apparatus according to the third embodiment of the present invention. The arithmetic processing unit 15 includes a sound source direction estimating unit 141, a delay applying unit 142 and a dereverberation processing unit 143.

The sound source direction estimating unit 141 estimates a sound source direction from a sound signal input from the A/D converter 14 and outputs the estimated sound source direction to the delay applying unit 142. The sound source direction estimating unit 141 estimates a sound source using a known sound source estimation method (for example, sound source exploration using Multiple Signal Classification or scan beam forming.

The delay applying unit 142 calculates delay time to be applied to each channel based on the sound source direction input from the sound source direction estimating unit 141, applies the delay time to the sound signal, and outputs a delay applying completion signal applied with the delay time to the dereverberation processing unit 143.

The dereverberation processing unit 143 calculates a dereverberation signal to reduce reverberation by applying an inverse filter to the delay applying completion signal input from the delay applying unit 142, and outputs the dereverberation signal to the RAM 16 in which the dereverberation signal is stored.

Figure 19:
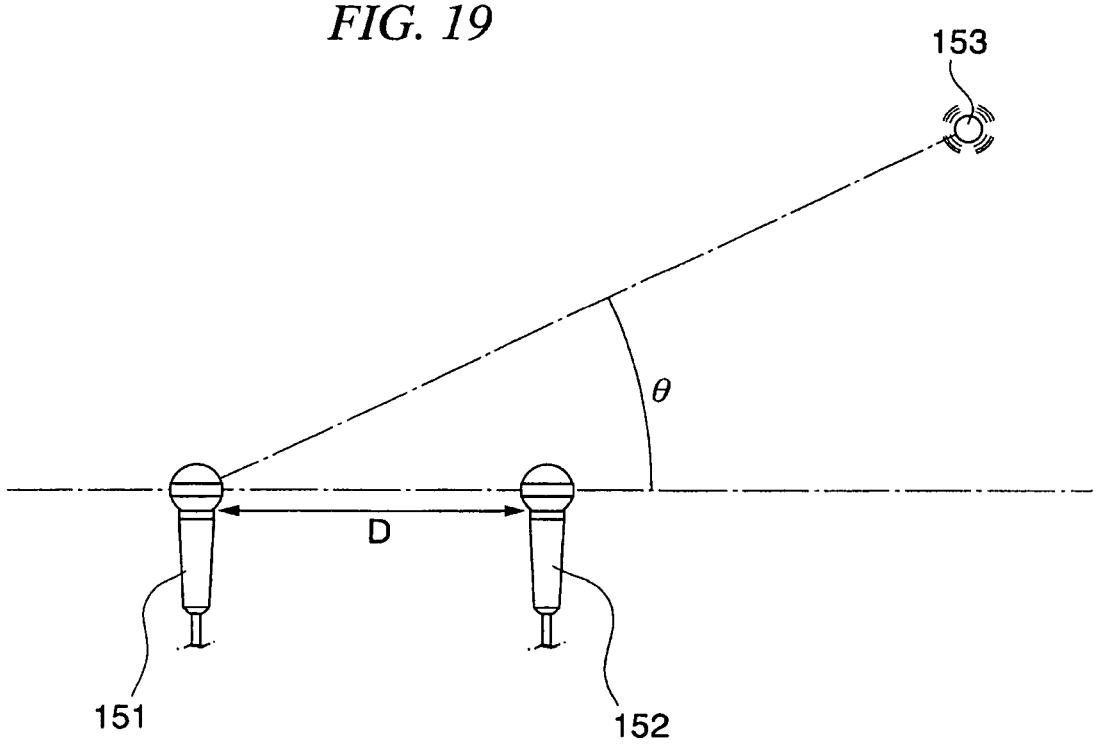
FIG. 19 is a view for explaining a position relationship between a reference microphone, a target microphone and a sound source.

Next, details of the process of the delay applying unit 142 will be described. FIG. 19 is a view for explaining a position relationship between a reference microphone, a target microphone and a sound source. In this figure, $\theta$ ($\theta \geq 0$) represents an angle formed by a line connecting a reference microphone 151 and a target microphone 152 and a line indicating a sound incoming direction. If $\theta$ lies within a range of 0 to 90 degrees, sound arrives at the target microphone earlier than the reference microphone. If $\theta$ is greater than 90 degrees, since sound arrives at the reference microphone earlier than the target microphone, a delay may not be applied to a signal received by the target microphone.

The delay applying unit 142 calculates delay time t to be set according to the following equation (17).

$$T=D\cos(\theta)/c+a \tag{17}$$

Where, D represents a distance between the microphones, c represents the velocity of sound, and a represents a small delay constant. The small delay constant a is used to prevent the start time of signals from being coincident between the microphones. Depending on a range in which a sound source 153 exists, $\theta$ in the equation (17) is set as follows.

(1) If $\theta$ is unknown, $\theta$ in the above equation (17) is set to be $\theta$ to maximize the distance between the microphones.

(2) If $\theta$ is defined by a range (for example, $\theta \geq \theta_{min}$), $\theta$ in the above equation (17) is set to be $\theta_{min}$.

(3) If the sound source direction estimating unit 141 can estimate a sound incoming direction, $\theta$ in the above equation (17) is set to be an estimated angle $\theta_{est}$.

As described above, if the range of sound incoming direction is defined, the delay time to be applied to a signal can be determined based on the time providing the largest delay in the range.

In addition, if the estimation precision of the sound source direction is poor, delay time may be calculated based on a result of estimation of the sound source direction and the distance between the microphones. More specifically, for example, the delay time is calculated by dividing the farthest distance between a plurality of microphones close to the estimated sound source direction by the velocity of sound. This allows the delay time to be properly calculated even if the estimation precision of the sound source direction is poor.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A dereverberation apparatus comprising:

a signal selecting unit which receives a plurality of input channels and selects a subset of the plurality of input channels to be used for a dereverberation process, the subset having fewer input channels than the plurality of input channels, wherein the signal selecting unit selects the subset of the plurality of input channels based on an evaluation value related to dereverberation performance; and a dereverberation processing unit which performs the dereverberation process for only the selected subset of input channels.

2. The dereverberation apparatus according to claim 1, further comprising a delay applying unit which generates a delay applying completion signal by delaying at least one of the plurality of input channels by a predetermined delay time, wherein the dereverberation processing unit performs the dereverberation process using the delay applying completion signal.

3. The dereverberation apparatus according to claim 2, further comprising a plurality of sound collectors which collects the input channels, wherein the delay applying unit calculates the delay time based on a distance between the sound collectors.

4. A multi-stage dereverberation apparatus comprising:

a plurality of dereverberation apparatuses according to claim 1 wherein the input channels subjected to the dereverberation process by the dereverberation processing unit are output as a dereverberation signal, wherein the dereverberation signal output from the dereverberation processing unit of one dereverberation apparatus is input to the signal selecting unit of another dereverberation apparatus.

5. The multi-stage dereverberation apparatus according to claim 4, wherein the signal selecting unit selects the input channels based on an evaluation value related to dereverberation performance.

6. The multi-stage dereverberation apparatus according to claim 4, further comprising a delay applying unit which generates a delay applying completion signal by delaying at least one of the plurality of input channels by a predetermined delay time, wherein the dereverberation processing unit performs the dereverberation process using the delay applying completion signal.

7. The multi-stage dereverberation apparatus according to claim 6, further comprising a plurality of sound collectors which collects the input channels, wherein the delay applying unit calculates the delay time based on a distance between the sound collectors.

8. A dereverberation method comprising:

a sound signal input step of inputting a plurality of input channels;

a signal selecting step of selecting a subset of input channels to be used for dereverberation process from the plurality of input channels input in the sound signal input step, the subset having fewer input channels than the plurality of input channels, wherein the signal selecting step selects the subset of input channels based on an evaluation value related to dereverberation performance; and a dereverberation processing step of performing the dereverberation process for only the selected subset of input channels.

9. A dereverberation apparatus comprising:

a delay applying unit which generates a delay applying a completion signal by delaying only a subset of a plurality of input channels by a predetermined delay time, the subset having fewer input channels than the plurality of input channels, wherein the subset of the plurality of input channels is selected based on an evaluation value related to dereverberation performance; and a dereverberation processing unit which performs a dereverberation process using the delay applying completion signal.

10. The dereverberation apparatus according to claim 9, further comprising a plurality of sound collectors which collects the input channels, wherein the delay applying unit calculates the delay time based on a distance between the sound collectors.

11. The dereverberation apparatus according to claim 9, further comprising a sound source direction estimating unit which estimates a sound source direction, wherein the delay applying unit calculates the delay time based on the sound source direction estimated by the sound source direction estimating unit.

12. The dereverberation apparatus according to claim 9, further comprising:

a plurality of sound collectors which collects the input channels; and a sound source direction estimating unit which estimates a sound source direction, wherein the delay applying unit calculates the delay time based on a distance between the sound collectors and the sound source direction estimated by the sound source direction estimating unit.

13. A dereverberation method comprising:

a sound signal input step of inputting a plurality of input channels;

a delay applying step of generating a delay applying completion signal by delaying only a subset of the plurality of input channels input in the sound signal input step by a predetermined delay time, the subset having fewer input channels than the plurality of input channels, wherein the subset of the plurality of input channels is selected based on an evaluation value related to dereverberation performance; and a dereverberation processing step of performing a dereverberation process using the delay applying completion signal.

* * * * *